US006062149A

United States Patent [19]

Duvivier et al.

[11] Patent Number: 6,062,149

[45] Date of Patent: May 16, 2000

[54] MODULAR FRAME WORKTOP

[75] Inventors: John Duvivier, San Mateo, Calif.; Lloyd C. Mollenkopf, Apple Valley, Minn.; Russell J. Rein, St. Louis Park, Minn.; James Hennan, Farmington, Minn.

[73] Assignee: Rosemount Office Systems, Inc., Lakeville, Minn.

[21] Appl. No.: 09/084,462

[22] Filed: May 26, 1998

[51] Int. Cl.[7] ..... A47B 3/06

[52] U.S. Cl. ..... 108/158.11; 108/153.1

[58] Field of Search ..... 108/153.1, 157.1, 108/158.1, 158.13, 159.11, 180, 186, 188, 187, 192, 193; 248/218.4, 219.2, 219.1, 219.3, 220.1, 220.21, 230.1

[56] References Cited

U.S. PATENT DOCUMENTS

| | | | |
|---|---|---|---|
| 1,800,685 | 4/1931 | Griffis | 108/159.11 |
| 1,870,174 | 8/1932 | Calton | 108/157.1 |
| 1,963,597 | 6/1934 | Schwabe . | |
| 1,979,843 | 11/1934 | Roos . | |
| 2,403,839 | 7/1946 | Adolph . | |
| 2,499,668 | 3/1950 | Morgan et al. . | |
| 2,521,596 | 9/1950 | Molla . | |
| 3,146,025 | 8/1964 | Heaney . | |
| 3,521,579 | 7/1970 | Stafford . | |
| 3,645,569 | 2/1972 | Reilly . | |
| 3,697,028 | 10/1972 | Nimmo . | |
| 3,737,136 | 6/1973 | Snurr . | |
| 3,741,514 | 6/1973 | Snurr . | |
| 3,851,601 | 12/1974 | Davis | 108/158.11 |
| 3,863,875 | 2/1975 | Olson . | |
| 3,886,710 | 6/1975 | Krause et al. . | |
| 3,912,410 | 10/1975 | Pofferi | 108/192 X |
| 3,985,083 | 10/1976 | Pofferi . | |
| 4,242,969 | 1/1981 | Checkwood et al. . | |
| 4,361,098 | 11/1982 | Rusch . | |
| 4,388,012 | 6/1983 | Erickson . | |
| 4,615,278 | 10/1986 | Cabrelli . | |
| 4,630,550 | 12/1986 | Weitzman . | |
| 4,691,885 | 9/1987 | Lawrence | 108/158.11 X |
| 4,848,245 | 7/1989 | Piretti . | |
| 5,035,186 | 7/1991 | Uredat et al. . | |
| 5,074,224 | 12/1991 | Stascheit . | |
| 5,230,491 | 7/1993 | Tseng . | |
| 5,354,025 | 10/1994 | McCaffery . | |
| 5,421,273 | 6/1995 | Lin | 108/187 |
| 5,579,703 | 12/1996 | King | 108/158.11 X |
| 5,598,790 | 2/1997 | Fich . | |
| 5,711,230 | 1/1998 | Parsons . | |

OTHER PUBLICATIONS

Hafele Brochure, *Idea Table Support System,* published Jan. 1997, pp. 1–7.

*Primary Examiner*—Jose V. Chen

*Attorney, Agent, or Firm*—Westman, Champlin & Kelly, P.A.

[57] ABSTRACT

A modular table assembly utilizes an X frame as a main component for mounting worktops, and has connectors for joining one X frame to another X frame for modularity purposes. Tubular splicer tubes are used for mounting components, such as cabinets or shelves above the worktop. A vertically adjustably clamp assembly is utilized for supporting arms that can be pivoted and which can form supports for monitors or keyboards or the like. The tubular legs supporting the X frame members are clamped securely to the tubular frame members using insert caps in the ends of the tubular frame members so clamps can be tightened securely without crushing the frame members.

11 Claims, 8 Drawing Sheets

MODULAR FRAME WORKTOP

BACKGROUND OF THE INVENTION

The present invention relates to a modular frame for a worktop that is formed at an X configuration, and has supporting legs which will receive extension splicer tubes that extend through the worktop and mount connectors to join frames together in various configurations. The splicer tubes also serve to provide supports for upper level shelves or cabinets.

A number of worktop designs utilizing various frame structures have been advanced in the art, such as those made by the Hafele Company, which utilize legs that lock in place and a modular table frame that has generally "Y" shaped ends under the worktops. A collapsible table that has a similar structure to Hafele Company products is shown in U.S. Pat. No. 1,179,843.

Prefabricated knock down metal frame work tables are illustrated in U.S. Pat. No. 4,630,550, and a support mounted on a leg and supporting a pair of worktops is shown in U.S. Pat. No. 5,035,186.

Various modular constructions of tables and worktops that can be placed into user selected configurations are presently available.

A tubular underframe used with tables and for other types of furniture is shown in U.S. Pat. No. 5,598,790, which uses internal connectors in the tubes that join adjacent tubes.

SUMMARY OF THE INVENTION

The present invention relates to a modular office worktop system that uses a basic X-shaped frame for supporting a worktop on tubular legs that have upper ends which will receive telescoping splicer tubes. Collars and clamps are held on the splicer tubes for supporting single frames and worktops and for adding additional worktops by "ganging" the frames. The legs also receive support casters if desired.

Sleeves are used on the splicer tubes above the worktop to support cabinets, shelves, monitors and the like, and other necessary or desired accessories.

One aspect of the invention is the X-shaped frame of rectangular cross section tube that has tube members extending from adjacent one corner toward a diagonally opposite corner, so that the frame tubes cross in the center of the worktop, forming the X. The support legs are out near the corners, at ends of the frame tubes and provide a convenient place for receiving splicer tubes that are used for clamps to rigidly support the legs and for ganging additional frames and worktops in place. Pivoting shelves or supports for monitors and the like are capable of being clamped onto the splicer tubes or the extender sleeves using a vertically adjustable collar assembly.

Another aspect of the invention is the ability to use tubular extender sleeves above the worktop for snap on housings that support outlets for power or communication. The housings also shield lines or cords above the upper surface of the worktops and guide the lines or cords along the sleeves as well as along the legs below the worktop.

The X frame also provides a convenient place for fastening lines or cords so they are not in the way of the user's feet. Other conventional items such as modesty panels, tack boards, accessory boards, privacy screens and the like can be provided easily.

The present invention provides for great flexibility in customizing worktop surfaces, as to size, location, and relative arrangement with other worktops that can be easily joined together, and for managing lines or cords.

BRIEF DESCRIPTION OF THE DRAWINGS

FIG. 13 is a sectional view showing a mounting member for providing an automatic adjustable lock for height adjustments of a support arm for a monitor, keyboard or the like;

DETAILED DESCRIPTION OF THE PREFERRED EMBODIMENTS

Figure 1:
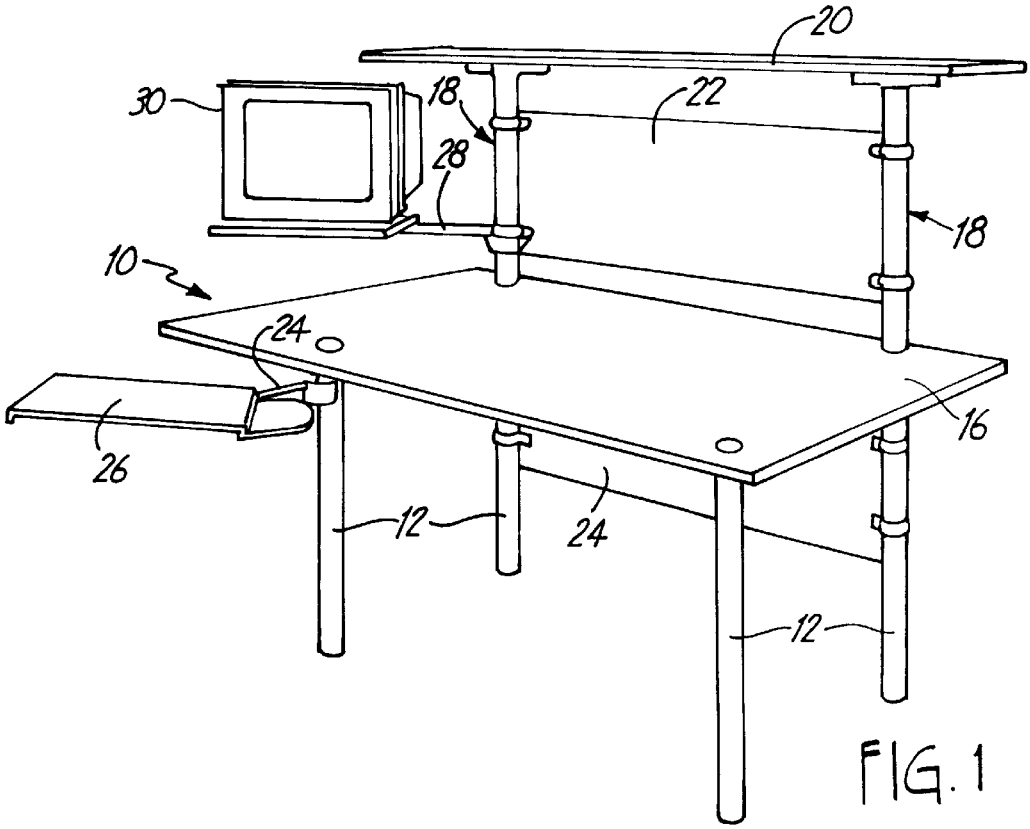
FIG. 1 is a schematic representation of a typical worktop utilizing components made according to the present invention.

Referring to FIG. 1, a schematic representation of a modular worktop 10 made according to the present invention includes a plurality of tubular legs 12 that are supported on an X frame (see FIG. 2) 14, and as can be seen, the worktop 16 is supported on the frame 14, and has apertures or openings that align with the tubular legs to permit support tube assemblies 18 to be passed through the worktop in desired locations. The support tube assemblies 18 can support shelves 20, as shown, above the worktop, and these can also support screens or modesty panels 22 and 24. The screens or modesty panels can be clipped on support tubes or the legs using simple clips.

Additionally, an arm assembly 24 is provided on one of the legs 12 for supporting a keyboard 26, and an arm 28 is supported on one of the support tube assemblies 18 for supporting a computer monitor 30.

The X frames are made so that they can be joined to other frames in a modular manner. The joining can be done directly, if the worktops are terminated along the center or bisecting planes of the openings for the legs, so that the worktop and edges abut together. These also can be linkages that support a small extension worktop which will permit folding the extension worktop relative to the main to move it out of the way if necessary.

Figure 2:
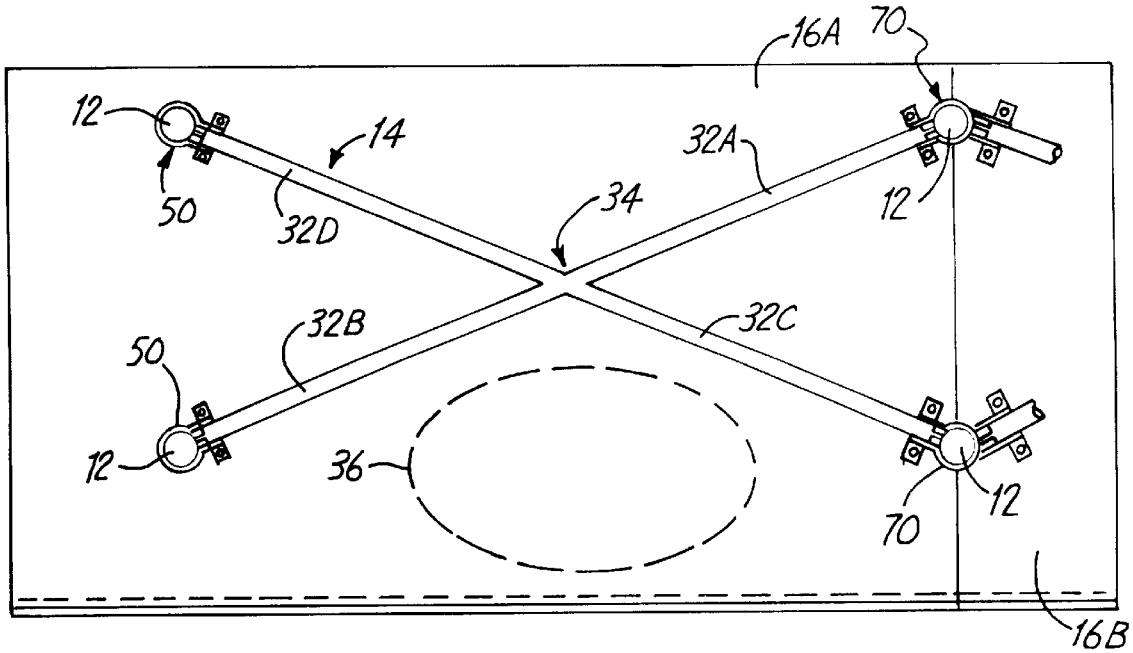
FIG. 2 is a bottom plan view of a typical worktop support frame having legs and a frame made according to the present invention.

Referring to FIG. 2, the frame 14 is shown in bottom view with the legs 12 in position. The frame is X-shaped, as shown, and has four form member segments of rectangular frame tubes indicated generally at 32A, 32B, 32C and 32D. The frame tubes 32A and 32B can be a continuous tube, and are on the same central axis, and a junction region 34 has to be accommodated so that the frame tubes are welded together or fixed permanently in the junction region 34. The frame tubes 32C and 32D are also on the same central axis to form the X shape. The X frame is made for convenience of the user, in that the entire region generally outlined by the line 36 is free of frame work so that the user's knees will be where there are no frame obstructions. This makes the frame very accommodating for supporting a worktop surface, and user friendly so that the user is not constantly bumping legs or frame parts.

The legs 12, as shown, can be arranged so that the worktop 16A that it illustrated in FIG. 2 has end edges on the bisecting line of the worktop legs, and a second worktop 16B can be abutted for supporting on a joining frame. The second worktop 16B has cutout receptacles for filling around support tubes concentric with the legs 12. A clamp member that is shown only schematically at 70, can be used on a splicer tube that, as will be explained, is fixed to the leg so it becomes and extension the leg. The splicer tube supports the clamp, which is used to join the tops 16A and 16B together.

Figure 3:
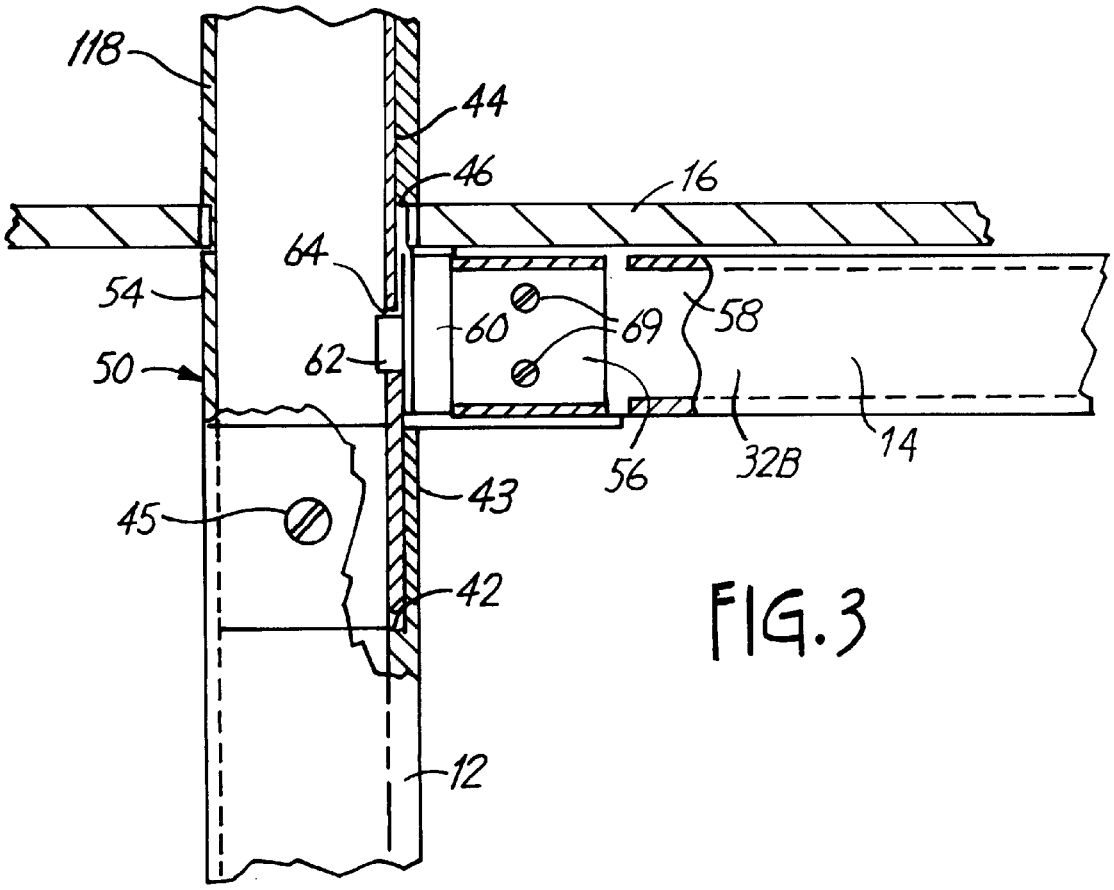
FIG. 3 is a fragmentary part sectional view showing a tube forming a frame member of an X frame attached to a leg of a first X frame made according to the present invention.

The upper portion of a typical leg for a stand alone frame and worktop is shown in FIG. 3, and includes a clamp collar member that is used for supporting a worktop 16 on the frame 14 when the frame is not joined to a second frame. The leg 12 is a tube, and as shown, has a counterbored upper portion that is made larger in diameter than the bore or opening of the tubular leg tube to form a shoulder 42 against which a splicer sleeve 44 can abut. The splicer sleeve 44 is slid inside the counterbored portion 43 and extends upwardly above the worktop 16. The splicer sleeve 44 can be held in place with a suitable set screw 45, which is threaded into the wall of the tubular leg 12. The splicer sleeve thus forms a part of the leg for supporting the worktop. The worktop 16 has suitable openings 46 that will permit the splicer tubes 44 to pass through and this opening can be large enough so that an outer support sleeve member shown at 48 and which is part of assembly 18 used for supporting a shelf abuts against a clamp hub 50 that is used for attaching the legs to the X frame members.

Figure 4:
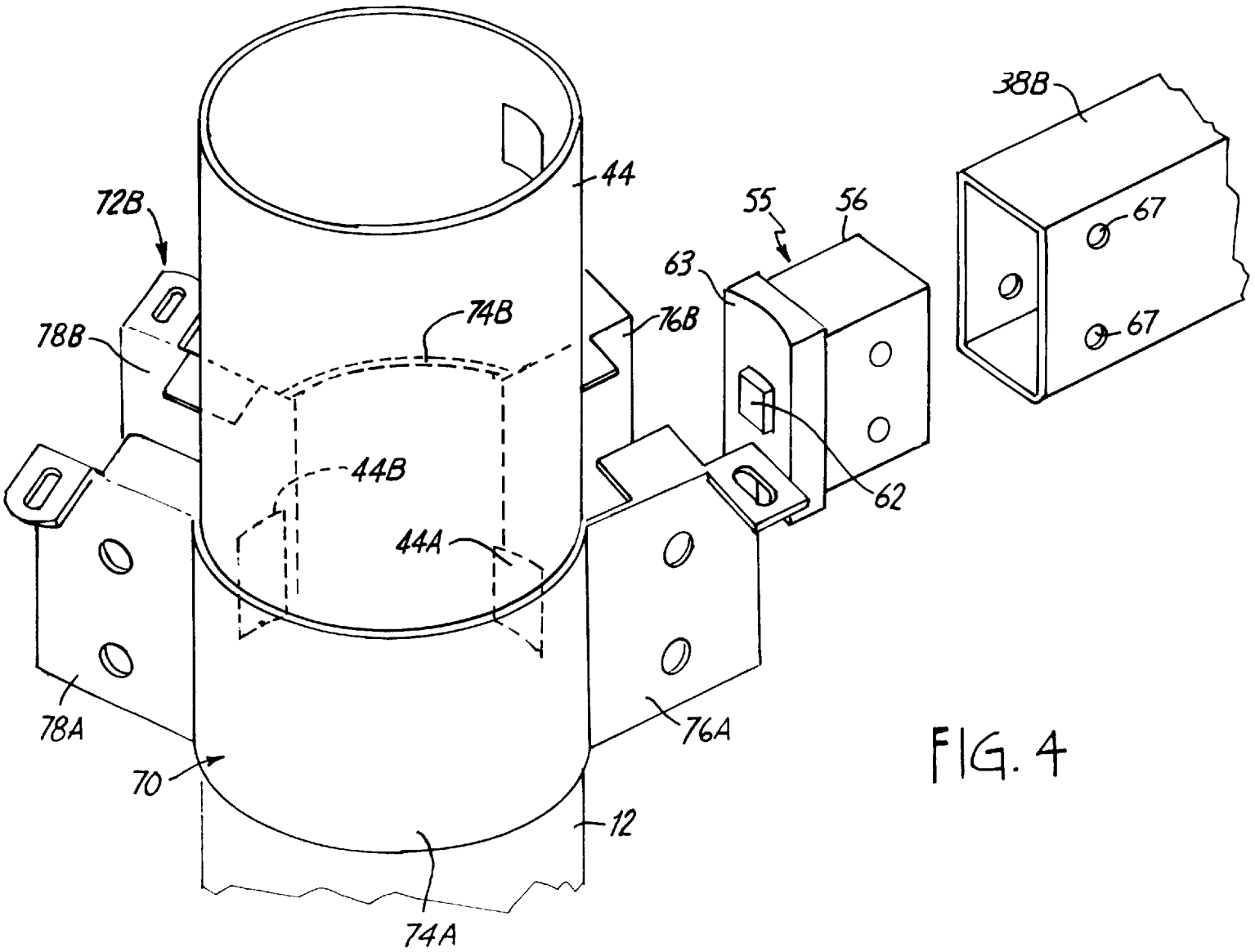
FIG. 4 is an exploded view of a connector in position for connecting two X frames together to a single tubular support leg.
Figure 5:
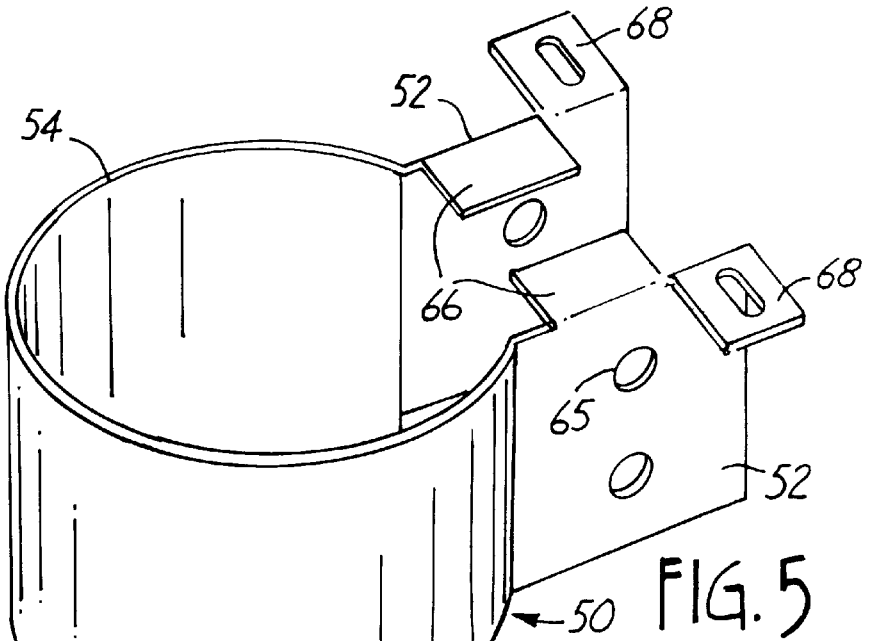
FIG. 5 is a perspective view of a clamp for supporting a worktop on a splicer tube and leg.
Figure 6:
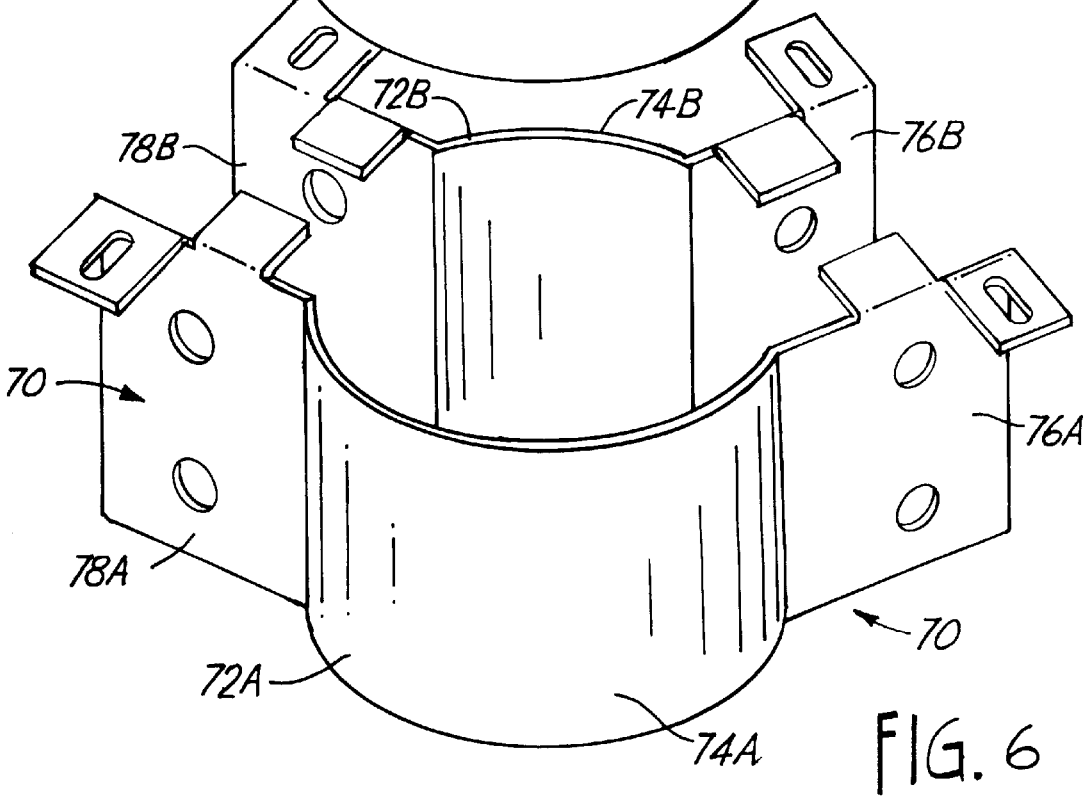
FIG. 6 is a perspective view similar to FIG. 5 showing a clamp used for supporting two X frames on a single leg made according to the present invention.
Figure 8:
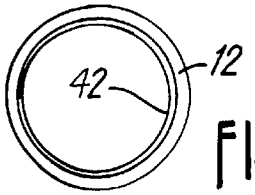
FIG. 8 is a top plan view of the leg of FIG. 7.

The clamp 50 is shown in FIG. 5. In FIG. 6, a clamp 70 is illustrated, which is used for joining two X frames together. Reference can be made to FIG. 4 to see the details of the assembly used for connecting X frame members to the respective legs. The clamp 50 has a single pair of flanges or ears 52, 52, that are integral with a band clamp 54 that fits around the splicer sleeve 44. The flanges 52 are spaced apart a sufficient distance so that they will fit over the outside of the X frame member to which they attach, such as the frame member 322 shown in FIG. 2.

In order to permit clamping the bands 54 onto the splicer sleeve tightly, an X frame cap 55 is provided, which has a solid clamp block 56 of size to slide into the interior bore 58 of the X frame member 32B. Cap 55 has a head 60 that is raised from the clamp block 56, and abuts against the end surface of the rectangular cross section tubular frame member 32B.

The head member 60 is provided with a boss or lug 62 that extends outwardly from a generally part cylindrical concave face 63 that fits against the splicer tube 44. The boss 62 projects through an opening 64 in the splicer tube 44 to support vertical (axial) loads and on the leg 12.

Flanges 52 of the clamp 50 are provided with inwardly bent tabs 66 at an upper edge that will rest on the top of the rectangular tube frame member 32B, and the flanges 52 have outwardly bent tabs 68 which have openings for receiving screws to attach the worktop 16 in place. Additionally, the flanges 52 have apertures 65 that align with apertures 67 in the rectangular tube frame members of the X frame to be supported, to receive clamp bolts 69 that pass through the flanges 52, through apertures 67 in the walls of the rectangular tube frame member 32B (the flanges are on the outside of the tube 32B) and through the clamp block 56 of the cap 55 so that the flanges 52 can be clamped solidly against the tubular frame member 32B and the block 56 so insure that the leg connecting clamp assembly will not loosen. As the bolts 69 are clamped, the band 54 tightens down onto the splicer sleeve 44 to securely hold the associated leg 12 in place.

When a leg 12 is to be used for joining a second modular worktop and X frame in position, the clamp 70 is utilized (see FIGS. 4 and 6). Clamp 70 is a two-part clamp having a first portion 72A and a second portion 72B that have band portions 74A and 74B that are part cylindrical and will fit around the splicer sleeve 44. The band portion 74A has flanges 78A that extend relative to each other at the desired angle to mate the angles of the frame tubes forming the adjoining X frame. The band portion 74B has flanges 76B and 78B that are parallel to the flanges 76A and 78A when the clamp 70 is assembled onto a splicer tube 44 as shown in FIG. 4.

When the splicer tube 44 is in position in a leg 12 that is going to be used for joining two frames together, it forms part of the leg and the band portions 74A and 74B are positioned around the splicer tube. The caps 55 are inserted into the ends of each of the X frame tubular members that are going to be joined, for example the X frame member 32B which would be used, with a worktop that has its end edge at the diameter line of the legs as illustrated in FIG. 2. The solid block 56 of a cap 55 would be slid into the end of the tubular frame member 32B as previously shown, and as shown in FIG. 4. The parts would be slid together, with the boss 62 extending through a provided opening 44A in the splicer tube 44, and the same type of a cap 55 would be slid into the tubular frame member that aligns with the flanges 78A and 78B. A second opening 44B is provided at that location on the splicer tube 44, so that the boss or lug 62 of that cap would protrude into the opening 44. The second frame member would be clamped in place between flanges 78A and 78B using suitable bolts such as those shown at 69. The adjoining tubular frame members at the opposite corners of the X frames would be joined to complete the attachment.

Figure 10:
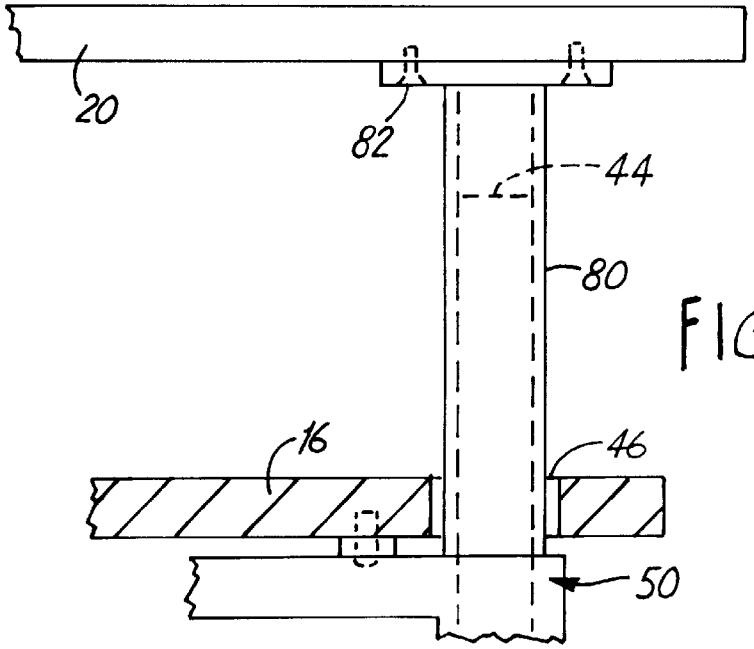
FIG. 10 is a fragmentary view showing a support sleeve or tube supporting a shelf above the supported worktop, and made according to the present invention.

When a shelf, such as that illustrated at 20 in FIG. 1 is to be mounted, the splicer tube 44 is used as a guide for sleeve supports for the shelf. The splicer tube extends up from the worktop 16, as shown in FIG. 10 a desired amount, and a support sleeve assembly 80 that has a top flange 82 that attaches to the shelf 20 is used. The support sleeve 80 is of size to slide over the splicer tube 44, and two such support sleeves 80 would be used on each shelf, so that they will locate the shelf properly, and space it properly above the table. The support sleeve 80 passes through the aperture shown at 46 in the worktop, and abuts against the locator clamp 50 and is thus supported in place on the lower leg 12.

In this way the shelf or cabinet support sleeves are easily used, for supporting shelves, cabinets, or similar compartments or components.

Figure 7:
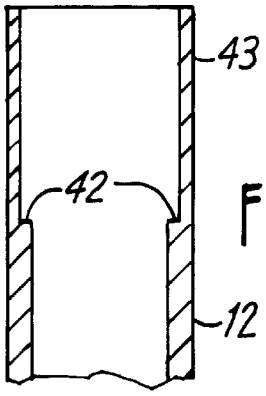
FIG. 7 is a vertical sectional view of a top portion of a typical leg made according to the present invention.
Figure 9:
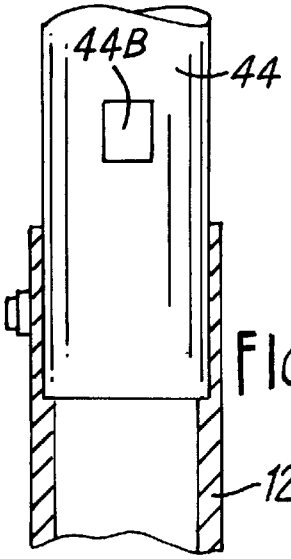
FIG. 9 is a sectional view similar to FIG. 7 showing a splicer sleeve in position on the leg.

FIG. 9 shows a splicer tube 44 mounted in a leg 12. The counterbored portion 43 of the leg 12 and the shoulder 42 are illustrated more clearly in FIG. 7.

Figure 12:
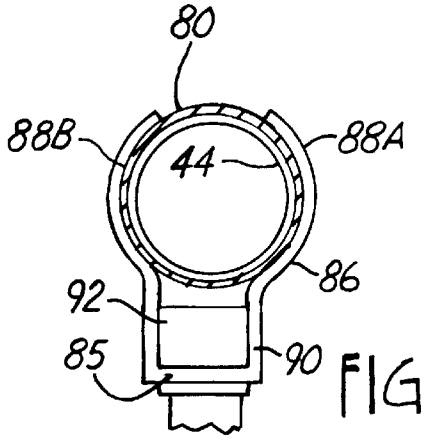
FIG. 12 is a top plan view of the support for communication and electrical outlets shown in FIG. 11.
Figure 11:
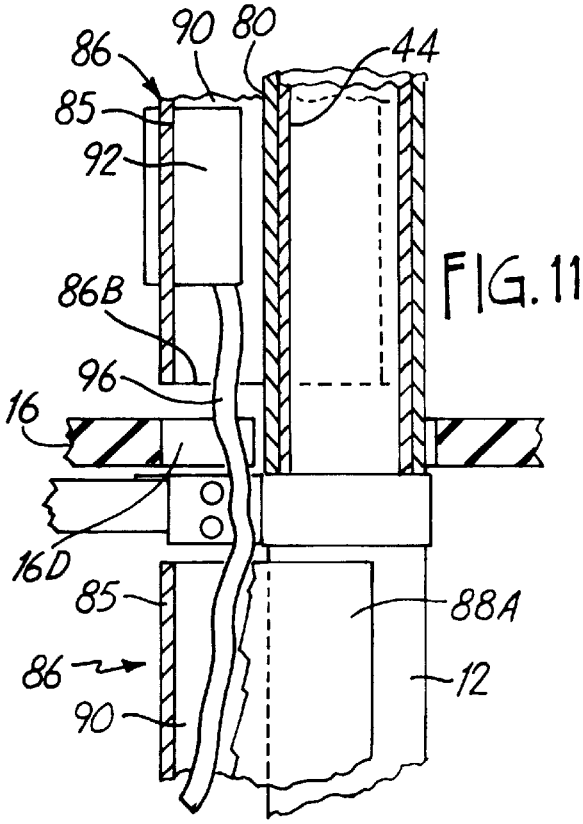
FIG. 11 is a schematic representational view of a snap on housing for supporting communication or electrical outlets, and showing a guide for managing lines or cords that are associated therewith relative to the edges of the worktop.

FIGS. 11 and 12 show a support snap on housing 86 for electrical or communication receptacles. Support housing 86 is made of a suitable resilient plastic, and has a base wall 85 molded integral with part cylindrical clamp bands 88A and 88B that can be sprung apart and snapped over the support sleeve 80, such as is used for the support of a shelf, above the worktop 16. This molded housing 86 also has a receptacle region 90 adjacent the base wall that is of size to receive a receptacle or jack 92 for communication plugs or for electrical power. The base wall 85 has a provided opening therethrough so a portion of the receptacle will protrude through. The portion 90 is made so the receptacles fit quite closely. The portion 90 is a forwardly projecting member. The snap on clamp bands 88A and 88B permit the housing 86 to be mounted at any desired height on the sleeve 80, and the housing can be as long as desired. For example, the housing can extend the full height of the support sleeve 80 if desired for aesthetic purposes. However, the lower edge 86B of the housing 86 is spaced above the worktop 16 and the worktop has a recess 16D so that a cord 96 can pass through the recess, and then down into a similar snap on housing 86 that is clamped onto the leg 12 below the worktop. The portion 90 for the lower housing 86 is used for guiding the cord to a desired location.

It is apparent that the cord could then run down to floor level and be plugged into a floor outlet, or floor communications jack, or the housing 86 can be relatively short and used to hold the cord close to the leg until the cord cleared the lower edge of the X frame members. Then the cord could be fastened with conventional fasteners or cable ties to the X frame members and directed along the length of the table as desired.

Figure 13:
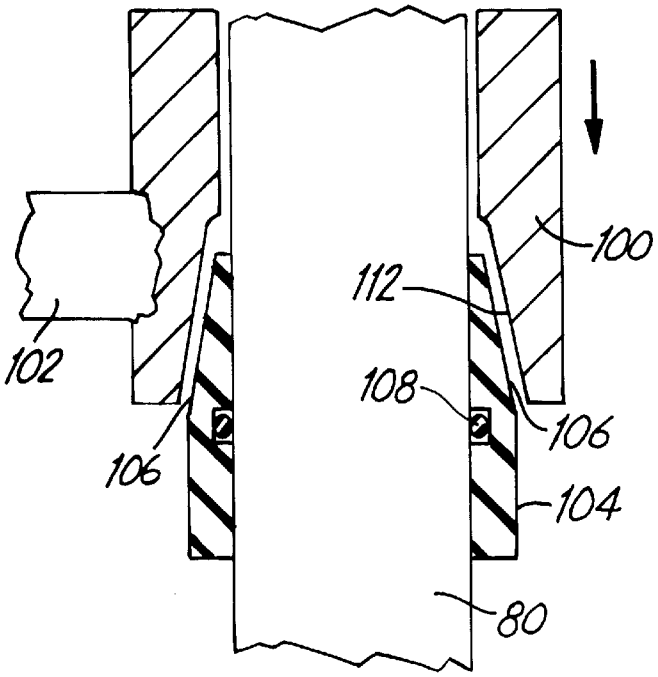
Figure 13A:
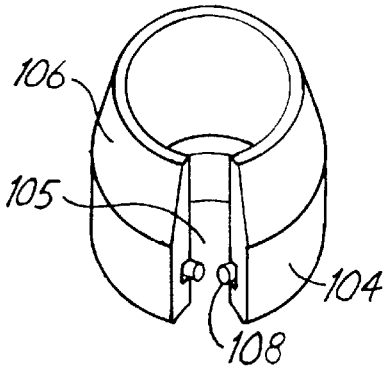
FIG. 13A is a perspective view of the lock ring shown in FIG. 13.

A keyboard arm or monitor arm, such as that shown at either 28 or 24 can be adjustably supported using an arrangement shown at FIG. 13. An adjustable lock sleeve 100 supports an arm 102. The lock sleeve 100 is a hub made of metal or rugged plastic, so that it will take the weight of an arm 102 supporting a monitor or a keyboard at a distance from a central cylindrical member such as the support sleeve 80 shown in FIG. 13, or from a leg 12 if the arm is to support a keyboard below the worktop. A plastic or low friction split ring 104 is made of size so that it will slide over the support sleeve 80, and resiliently engage the outer surface of the support sleeve. The ring 104 has an axial gap 105 and a tapered, part conical wedge like exterior upper surface 106. An interior groove is formed in the split ring to receive an O-ring 108 that is of size so that it will create a friction load against the sleeve 80 when the plastic split ring 104 is positioned over the tube 80. The lock sleeve or hub 100 has an interior part conical surface 112 that will mate with and engage the surface 106 as the hub slides down onto the split ring 104. The hub overlies at least a portion of the split ring surface 106. The surfaces 112 and 106 wedge together with sufficient clamping force so that the gap of the split ring will tend to close and the O-ring will prevent the split ring and lock sleeve or hub from sliding axially along the support sleeve 80. This locking action will maintain the arm 102 at a desired height. The arm 102 can be rotated on the plastic split ring without disturbing the vertical or axial setting, to the extent necessary for minor adjustments.

The split ring has a gap so it will compress easily, and the lock sleeve or hub 100 can be made in two sections that are bolted together or otherwise fastened together, or it can be a continuous annular hub. It will form a continuous ring when in place on the support sleeve 80.

Figure 14:
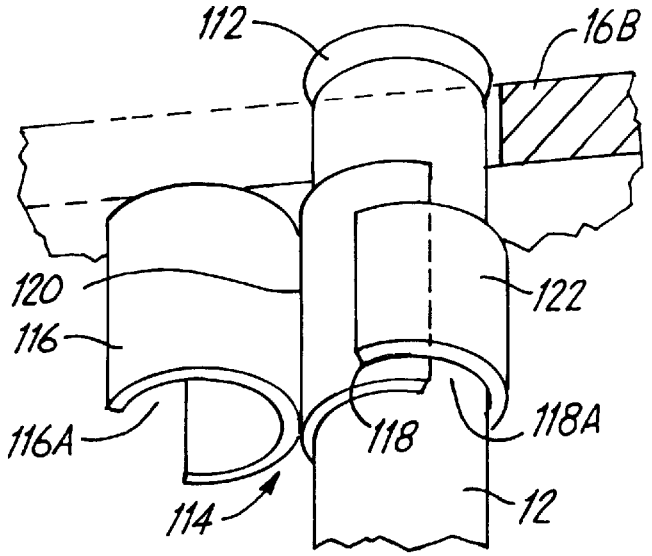
FIG. 14 is a fragmentary bottom perspective view of a simplified connector for the X frames utilizing snap on components.
Figure 15:
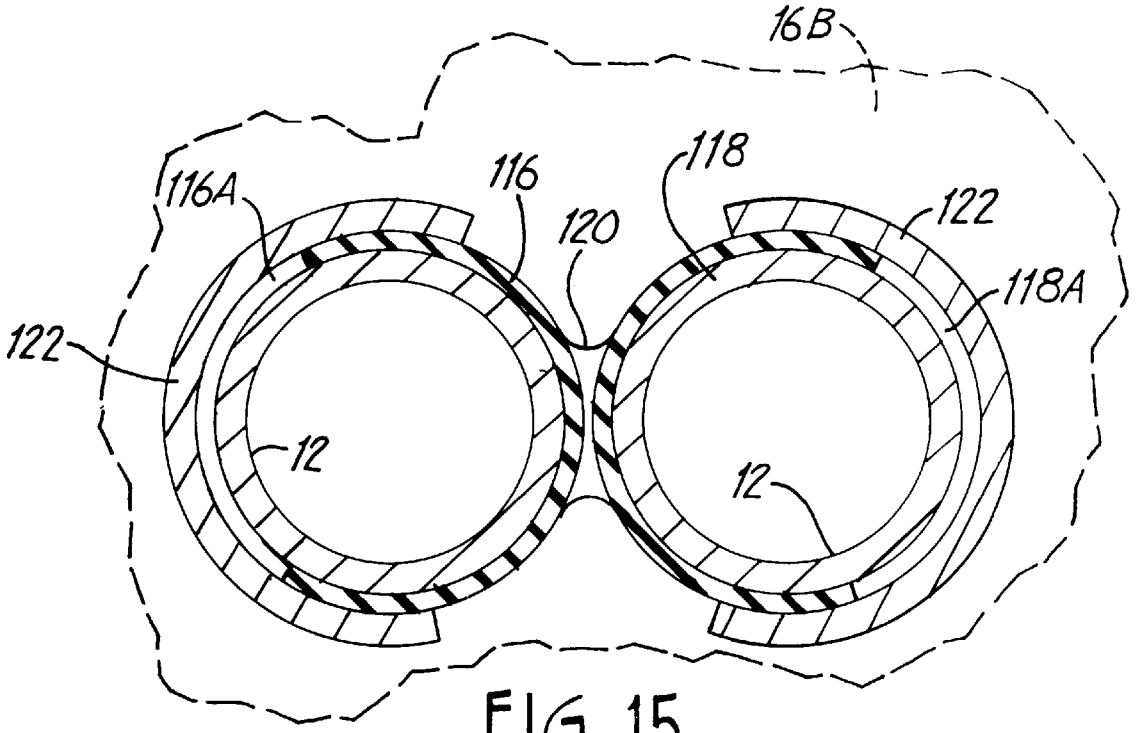
FIG. 15 is a top plan view of the connector of FIG. 14.

A simplified, snap-on holder can be utilized for connecting two support legs together as shown in FIGS. 14 and 15.

FIG. 14 is a bottom perspective view of a typical leg 12 showing a worktop 16B above it, and in this form of the invention, a cap 112 is shown threaded into the interior of the leg 12 above the worktop in place of the splicer tube 44. The interior of the leg 12 at the counterbore region 43 can be threaded with fine threads if desired, to permit cap 112 to be threaded into place and protrude slightly have the worktop 16B but yet give a finished appearance. Flush caps can also be used.

A snap-on leg connector 114 comprises first and second part cylindrical flexible or springy members 116 and 118. These flexible part cylindrical members 116 and 118 may be made of plastic (such as ABS plastic) and are joined together back to back at 120 in a suitable manner, such as a suitable epoxy or similar adhesive or bonding so that they bond securely to form a single assembly. The gaps shown at 116A and 116B face in opposite directions.

FIG. 15 is a sectional view of the assembly, and the members 116 and 118 are shown to be greater than half a cylinder (more than 180° around the legs 12) so that they will clamp onto the legs 12. Then, a spring material "C" clamp such as a metal, part cylindrical lock clamp 122 is positioned over the open section or gaps 116A and 118A of the clamps 116 and 118 and provides a lock clamp that holds the side portions of the clamps 116 and 118 tightly against the leg 12, so that the clamps cannot separate and release.

This type of a clamp assembly makes an easy to use frame junction member that will hold two legs 12 very close to each other, so that the worktops 16A and 16B, for example, can be bolted in place on supports on the legs. A suitable opening in the worktop 16A can be made, so that the frame members and the legs will be positioned inwardly slightly from the ends of the worktops.

Figure 16:
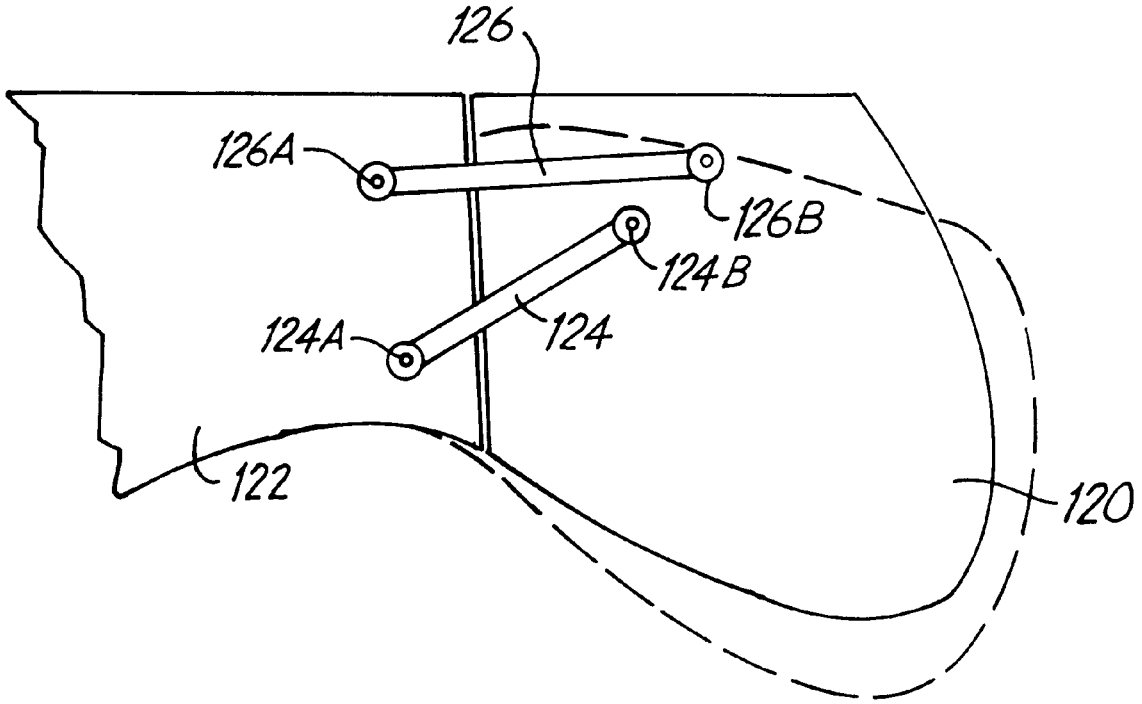
FIG. 16 is a schematic representation of a linkage used for supporting an auxiliary worktop section.

In FIG. 16, a schematic representation of an arrangement for mounting an extension worktop is shown from the bottom of the worktop. An extension worktop portion 120 is supported to a worktop 122 through pivoting links 124 and 126, which are of different lengths, as shown. Link 124 is pivoted at 124A to the bottom of the main worktop 122, and at 124B to the bottom extension worktop 120. The link 126 is pivoted at 126A to the main worktop 122 and at 126B to the extension worktop 120. The links and pivots are made of sufficient strength to hold the extension worktop adequately. The arrangement of different length links permits pivoting of the extension worktop to more than one position and remain supported.

The clamps that are used for attaching legs to the frame members can be clamped directly to the tubular legs, if desired, instead of the splicer tubes.

Although the present invention has been described with reference to preferred embodiments, workers skilled in the art will recognize that changes may be made in form and detail without departing from the spirit and scope of the invention.

What is claimed is:

1. A supporting frame assembly for a worktop comprising tubular frame members extending diagonally from adjacent first end corners of the worktop to adjacent second end corners of the worktop and forming an X configuration in plan view, and a separate cap having a filler block in each end portion of each of the tubular frame members for supporting sidewalls of the tubular members adjacent ends thereof against clamping pressure.

2. The supporting frame of claim 1 wherein the diagonally extending frame members intersect in central portions of the worktop and are fixed relative to each other.

3. The supporting frame of claim 1 and leg support brackets at the ends of the frame members and bolted thereto through the filler blocks of the caps.

4. The supporting frame of claim 3 including a leg support bracket for each frame member having first flanges to receive an end portion of a frame member, the first flanges being bolted to the associated frame member with bolts that pass through the filler block therein, and second flanges on the leg support and extending at an angle relative to the first flanges, the second flanges receiving a frame member of a second work top supporting frame.

5. The supporting frame of claim 1, further including a leg support bracket on each end of the frame members, the leg support bracket having flanges that clamp on the exterior of the respective frame members adjacent ends thereof, and including a part cylindrical band portion to clamp onto a cylindrical member forming at least part of a worktop support leg.

6. A supporting frame assembly for a worktop comprising tubular frame members, having opposite ends and extending diagonally from adjacent first end corners of the worktop to adjacent second end corners of the worktop and forming an X configuration in plan view, a leg attachment bracket and clamp assembly for each of the opposite ends of each tubular frame member end comprising a bracket having a pair of flanges that are of size to fit on the exterior of the respective end portion of a tubular frame member and at least a part cylindrical band to clamp around a cylindrical member forming a part of a leg, and a cap for the end of the respective tubular frame member including a block that inserts into the tubular frame member at the end portion, and the cap having a boss that extends outwardly from the tubular frame member, the cylindrical member having an aperture to receive the boss when the part cylindrical band is in place around the cylindrical member and holding the cylindrical member relative the end portion of the respective tubular frame member.

7. A supporting frame assembly for a worktop comprising frame members having ends and extending diagonally from adjacent first end corners of the worktop to adjacent second end corners of the worktop and forming an X configuration in plan view, the frame assembly including tubular legs at the ends of the frame members, the tubular legs having counterbores at upper ends thereof of size to receive splicer tubes in the counter bore, the splicer tubes extending upwardly through the worktop from at least two tubular legs, and an accessory support sleeve mounted over each splicer tube and forming supports for accessories on the work top.

8. The support frame of claim 7 and an arm support on the support sleeve, the arm support comprising a split ring partially encircling the support sleeve, and having a tapered exterior surface decreasing in size in upward direction, a hub surrounding the split ring and having an interior surface tapered to mate the tapered surface of the split ring to tend to close the split ring onto the support sleeve, and a resilient elastomeric member carried on the interior of the split ring that engages the support sleeve.

9. The support frame of claim 8 wherein the tapered exterior surface of the split ring is conical.

10. A support frame assembly for a worktop comprising frame members extending diagonally from adjacent first end corners of the worktop to adjacent second end corners of the worktop and forming an X configuration in plan view, wherein the frame members have ends, a separate leg to support each frame member end, and a coupling member for joining a leg of a first frame assembly to a leg of a second frame assembly comprising a pair of part cylindrical resilient clips, the clips forming walls that extend for more than 180 degrees and defining an opening extending between longitudinal edges of the clips, the clips being of size to resiliently grip the legs of the first and second support frame assemblies simultaneously, the clips being secured together with the openings in the clips facing in opposite directions.

11. The support frame of claim 10 wherein the clips comprise first clips, and a separate lock clip mounted over the openings of each of the first clips, the lock clips being part cylindrical and spanning the openings in the first clips and resiliently urging the openings in the first clips to close.

* * * * *